US006715997B2

(12) United States Patent
Frantz et al.

(10) Patent No.: US 6,715,997 B2
(45) Date of Patent: Apr. 6, 2004

(54) HOUSING FOR A ROTARY HYDRAULIC UNIT WITH A SERVO PISTON

(75) Inventors: Stephen C. Frantz, Oak Ridge, TN (US); Robert J. Klinkel, Ames, IA (US)

(73) Assignee: Sauer-Danfoss Inc., Ames, IA (US)

( * ) Notice: Subject to any disclaimer, the term of this patent is extended or adjusted under 35 U.S.C. 154(b) by 78 days.

(21) Appl. No.: 10/126,359

(22) Filed: Apr. 19, 2002

(65) Prior Publication Data

US 2002/0157530 A1 Oct. 31, 2002

Related U.S. Application Data

(60) Provisional application No. 60/287,665, filed on Apr. 30, 2001.

(51) Int. Cl.[7] ..... F04B 49/00; F04B 1/26; F01B 13/04

(52) U.S. Cl. ..... 417/218; 417/222.1; 91/506

(58) Field of Search ..... 91/504, 505, 506; 417/269, 218, 222.1; 92/71

(56) References Cited

U.S. PATENT DOCUMENTS 3,190,232 A * 6/1965 Budzich ..... 417/222.1
3,221,660 A * 12/1965 D'Amato ..... 417/222.1
3,612,724 A 10/1971 Smith et al.
3,728,943 A * 4/1973 Lucien ..... 91/506
3,736,073 A 5/1973 Walmsley
3,834,281 A 9/1974 Heyl et al.
3,834,836 A 9/1974 Hein et al.
3,915,030 A 10/1975 Ritter
4,028,010 A 6/1977 Hopkins
4,444,092 A * 4/1984 Schott ..... 91/486
4,896,585 A 1/1990 Forster
4,945,817 A * 8/1990 Scholl ..... 91/505
5,123,815 A 6/1992 Larkin et al.
5,918,529 A 7/1999 Forster

* cited by examiner

*Primary Examiner*—Justine R. Yu
*Assistant Examiner*—Timothy P. Solak

(57) ABSTRACT

A variable displacement hydraulic power unit has a housing and a rotating piston block with a rotatable axis and a servo piston bore having a reciprocal piston therein with the bore extending in a direction parallel to the rotatable axis of the rotating piston block. The housing and servo piston each have adjacent open ends. A single integral cover is attached to the housing to cover close and close the open ends of both the housing and the piston bore.

1 Claim, 1 Drawing Sheet

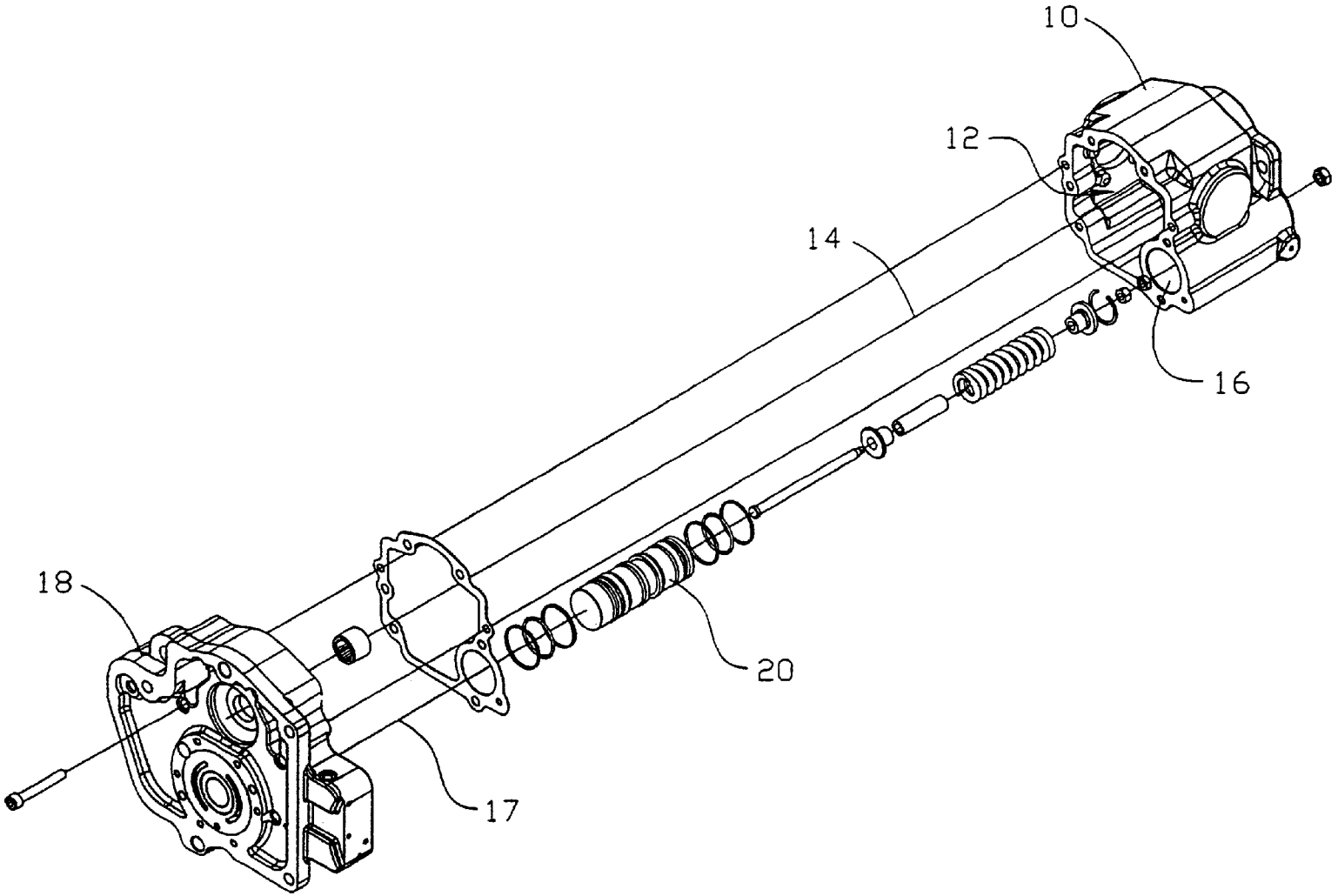
10
12
14
16
17
18
20

HOUSING FOR A ROTARY HYDRAULIC UNIT WITH A SERVO PISTON

CROSS REFERENCE TO A RELATED APPLICATION

This application is a conversion of Provisional Patent Application Ser. No. 60/287,665 filed Apr. 30, 2001.

BACKGROUND OF THE INVENTION

Historically, servo controls on an axial piston closed circuit pump have used a transverse servo bore and piston with one or two servo covers to seal the servo cavity. These servo covers add cost since they result in additional parts, additional machining to mating parts, and potential leak paths.

The other issue has been package size. Control resolution performance improves with a longer moment arm and the corresponding longer servo piston travel. In a traditional transverse servo piston arrangement, increasing servo piston travel increases package size, especially in the width dimension. With an axial servo piston, however, the longer servo piston travel can be accommodated while optimizing the width and without increasing the length of the pump.

It is therefore a principal object of the invention to provide an axial servo control having a housing and a piston block with a rotatable axes and a servo piston bore with a single cover attached to the housing to close adjacent open ends in both the housing and the piston bore.

SUMMARY OF THE INVENTION

A variable displacement hydraulic power unit has a housing and a rotating piston block with a rotatable axis and a servo piston bore having a reciprocal piston therein with the bore extending in a direction parallel to the rotatable axis of the rotating piston block. The housing and servo piston each have adjacent open ends. A single integral cover is attached to the housing to close the open ends of both the housing and the piston bore.

DESCRIPTION OF THE DRAWING

The sole drawing FIGURE is an exploded perspective view of the invention.

DESCRIPTION OF THE PREFERRED EMBODIMENT

The invention is shown in the enclosed drawing which shows the housing 10 with a cavity 12 to receive a rotational cylinder block having a center axis 14. The servo piston bore 16 has an open end as does the cavity 12. An end cap or cover 18 is secured in any convenient way to cover both the cavity 12 and servo bore 16. The numeral 20 designates the servo piston in bore 16 which has a longitudinal axis 17.

This arrangement of structure permits both the cavity 12 and the bore 16 to be completely closed by the single integral end cap or cover 18, thus eliminating the necessity for the cavity 12 and the bore 16 to have separate covers or end caps.

The use of an axial servo piston allows the variable pump housing and the end cap (or center section) to serve as the means for sealing the ends of the servo cavity. This eliminates the need for additional covers, fasteners (and washers), seal, and associated assembly time. The pump housing cast material which seals the servo cavity can be used to ground the servo tie bolt, allowing for access from the outside of the pump to perform neutral adjustments.

It is therefore seen that this application will achieve at least its stated objectives.

We claim:

1. A variable displacement hydraulic power unit having a housing and a rotating piston block with a rotatable axis and said housing having a servo piston bore having a reciprocal piston therein with the bore extending in a direction parallel to the rotatable axis of the rotating piston block, comprising, the housing and the servo piston bore each having first adjacent open ends located in a substantially planar surface, a single integral cover attached to the housing to close both the open ends of the housing and the piston bore, and the rotating piston block being located entirely within the housing with the cover having a substantially planar surface to match the planar surface containing the open ends of the housing and piston bore.

* * * * *